US007029148B2

(12) United States Patent
White et al.

(10) Patent No.: US 7,029,148 B2
(45) Date of Patent: Apr. 18, 2006

(54) LUMINAIRE HAVING SYMMETRICALLY OPPOSED ASYMMETRICAL REFLECTORS

(75) Inventors: Barry White, Newburg, NY (US); Steve Proner, Woodstock, NY (US)

(73) Assignee: LSI Industries Inc., Cincinnati, OH (US)

( * ) Notice: Subject to any disclaimer, the term of this patent is extended or adjusted under 35 U.S.C. 154(b) by 137 days.

(21) Appl. No.: 10/616,743

(22) Filed: Jul. 10, 2003

(65) Prior Publication Data

US 2005/0018427 A1 Jan. 27, 2005

(51) Int. Cl.
*F21V 7/09* (2006.01)

(52) U.S. Cl. ..... 362/238; 362/225; 362/240; 362/241

(58) Field of Classification Search ..... 362/225, 362/238, 240, 241, 247, 291, 346, 311, 16, 362/17, 217, 227, 221–223, 235–237, 257, 362/260, 290, 292, 296, 297, 310, 317, 341, 362/342, 348, 350
See application file for complete search history.

(56) References Cited

U.S. PATENT DOCUMENTS 2,050,429 A * 8/1936 Dorey et al. ..... 362/224
2,291,494 A * 7/1942 Lorenz ..... 362/224
2,323,073 A * 6/1943 Netting ..... 362/225
2,875,323 A * 2/1959 Harling ..... 362/225
3,123,308 A * 3/1964 Franck ..... 362/224
3,246,138 A * 4/1966 Florence ..... 362/217
3,591,798 A * 7/1971 Florence ..... 362/225
4,287,554 A * 9/1981 Wolff ..... 362/240
4,342,072 A * 7/1982 Guritz et al. ..... 362/222
4,536,830 A * 8/1985 Wisniewski ..... 362/223
4,866,584 A * 9/1989 Plewman ..... 362/225
4,928,209 A * 5/1990 Rodin ..... 362/221
5,371,661 A * 12/1994 Simpson ..... 362/221
5,570,947 A * 11/1996 Felland ..... 362/225
5,615,943 A * 4/1997 Coldren ..... 362/225
5,921,666 A * 7/1999 Preston et al. ..... 362/341
6,170,962 B1 * 1/2001 Wordin ..... 362/247
6,585,396 B1 * 7/2003 Verfuerth ..... 362/221

* cited by examiner

*Primary Examiner*—Thomas M. Sember
*Assistant Examiner*—Ismael Negron
(74) *Attorney, Agent, or Firm*—Daniel F. Nesbitt; Hasse & Nesbitt LLC

(57) ABSTRACT

A luminaire comprising a housing, plurality of reflectors, lamps and electrically connected lamp sockets. The luminaire has at least two asymmetrical reflectors that are symmetrically opposed to each other and ideally has at least one symmetrical reflector located between the asymmetrical reflectors.

20 Claims, 5 Drawing Sheets

LUMINAIRE HAVING SYMMETRICALLY OPPOSED ASYMMETRICAL REFLECTORS

FIELD OF THE INVENTION

This invention relates generally to luminaires and more particularly to luminaires using reflectors to provide widespread lighting footprint.

BACKGROUND OF THE INVENTION

A commonly used type of luminaire for illuminating large work areas is a reflective, fluorescent luminaire. These luminaires are typically either recessed into the ceiling or are mounted on the ceiling within a housing that contains the reflector(s) and lamps. Common applications include lighting for offices, workspaces or large retail areas.

Existing fluorescent luminaires typically include a number of fluorescent lamps disposed within a housing and have reflectors placed above the lamps. Often louvers are placed below the luminaire to prevent scattering of the light and to focus the light onto the horizontal surface below. As the fluorescent tubes are usually long and narrow, these luminaires also tend to be long and narrow. The industry standard fluorescent luminaire has eighteen cells formed by the louvers and uses three thirty-two Watt lamps. Most of the assemblies and reflectors are symmetrical. A drawback associated with such symmetrical luminaires is that the reflector is not particularly efficient because of internal reflections, the resulting light distribution pattern has low vertical foot-candles and the light pattern emitted is not optimized for any particular application.

In many lighting applications, the design goal is to provide a widespread light distribution pattern throughout the entire 180 degree area beneath the luminaire along with the greatest efficiency possible. The widespread light pattern increases the footprint over which light is projected and also results in increased vertical foot candles. As opposed to measuring just the light intensity on the horizontal area beneath the luminaire, vertical foot candles measures the amount of light intensity on a vertical surface below the luminaire. Increased vertical foot candles can be desirable for applications that require light to be spread over a vertical surface such as a display rack, rather than being focused down onto the top of a horizontal surface such as a desk. Also, the greater the efficiency of the luminaire the more light there is that is available for the widespread footprint, thereby resulting in increased light intensity throughout the footprint. Greater efficiency also permits the use of smaller wattage, energy saving lamps in the luminaire. To achieve these goals, some other luminaires have used asymmetrical reflectors and asymmetrical lamp placements, however, most of these are for applications in which the luminaires are used to direct light only onto a specific area. These approaches have been used in a variety of luminaires, including those by Krogsrud in U.S. Pat. No. 4,683,526, by Grierson in U.S. Pat. No. 5,727,870 and by Shemitz in U.S. Pub. No. US2002/0003699. In each of these examples the luminaire provides increased wide angle lighting and vertical foot candles in a particular region below the luminaire, however, such increases are made at the expense of the lighting directly below the luminaire.

Another approach is to use an adjustable reflector to permit lighting the desired area regardless of the specific application. This however, results in a less stable luminaire that requires adjustment and costs more to manufacture because of the added complexity of having moving parts.

Further, the efficiency of such luminaires is greatly reduced either because they use materials that are flexible that are not the best possible reflectors or they use more solid reflector elements that are moved around but have spacing between the elements. An example of the flexible approach is shown by Waldmann in U.S. Pat. No. 6,244,729. An example of the movable elements approach can be seen by Littman in U.S. Pat. Nos. 5,564,815 and 5,803,585.

Thus, there is a substantial need for a luminaire that can provide wide angle lighting and significant vertical foot candles without requiring adjustment during installation or based upon subsequent applications.

SUMMARY OF THE INVENTION

The present invention provides a luminaire comprising: a housing; a plurality of reflectors disposed within said housing, wherein at least two of said reflectors are asymmetrical reflectors that are symmetrically opposed from each other; lamps disposed beneath each of said reflectors; and lamp sockets disposed within the reflector areas being sized to receive the base of said lamps, said lamp sockets being electrically connected to a power source and having an electrical contact and being electrically connectable to the bases of said lamps. Each of the asymmetrical reflectors has a generally parabolic shape.

Preferably, the portion of the asymmetrical reflector located centrally above the lamp has a peak shape, and the portion of the asymmetrical reflector located toward the inner side of the peak shape portion is a narrower parabolic shape than the portion of the asymmetrical reflector located toward the outer side of the peak shape portion.

The present invention is a luminaire which overcomes wide angle lighting drawbacks associated with the currently existing luminaires. More specifically, the luminaire comprises a housing in which multiple lamps are each disposed within their own reflectors and the reflectors have at least a pair of asymmetric reflectors that are disposed symmetrically relative to each other. This permits the middle lamps and reflectors, if used, to provide a standard light distribution pattern, while the outer asymmetric pairs are used to provide a wider angle of illumination and increased vertical foot candles.

In the preferred embodiment, the luminaire has three lamps and reflectors, including one symmetrical reflector in the center and two asymmetrical reflectors on the sides. The center lamp and reflector provides a standard light distribution pattern that is focused on the horizontal space below the luminaire, while the two side lamps and reflectors are principally responsible for providing the increased wide angle illumination and vertical.

The preferred embodiment of the luminaire disclosed herein has resulted in an eighty-five percent efficiency rating which makes the luminaire eligible for many available energy rebate programs. Further, the luminaire provides fifty percent greater vertical foot candles than the industry standard for luminaires having eighteen cells and using three thirty-two Watt lamps.

It would also be possible to use arrangements in which no symmetrical reflectors were used, but only pairs of asymmetrical reflectors disposed symmetrically relative to each other, so two, three, four or more pairs of lamps and reflectors could provide wider luminaires if required for an application.

Likewise, it would also be possible to use an arrangement where multiple lamps and symmetrical reflectors were used in the middle of the luminaire with the asymmetrical reflectors and lamp pairs being used toward the outside of the luminaire for similar mixed light distribution patterns.

By virtue of the foregoing, there is thus provided a luminaire that provides increased vertical foot candles and a widespread light distribution pattern. Additionally, the design of the reflectors provides a high efficiency as the result of the minimized internal reflections, thereby providing greater illumination and permitting the use of lower wattage lamps, thereby reducing usage of electricity while preserving usable light output. Further, the luminaire permits use of a single luminaire type for varying applications without requiring reflector adjustments.

These and other objects and advantages of the present invention shall become apparent from the accompanying drawings and the detailed description thereof

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

Figure 1:
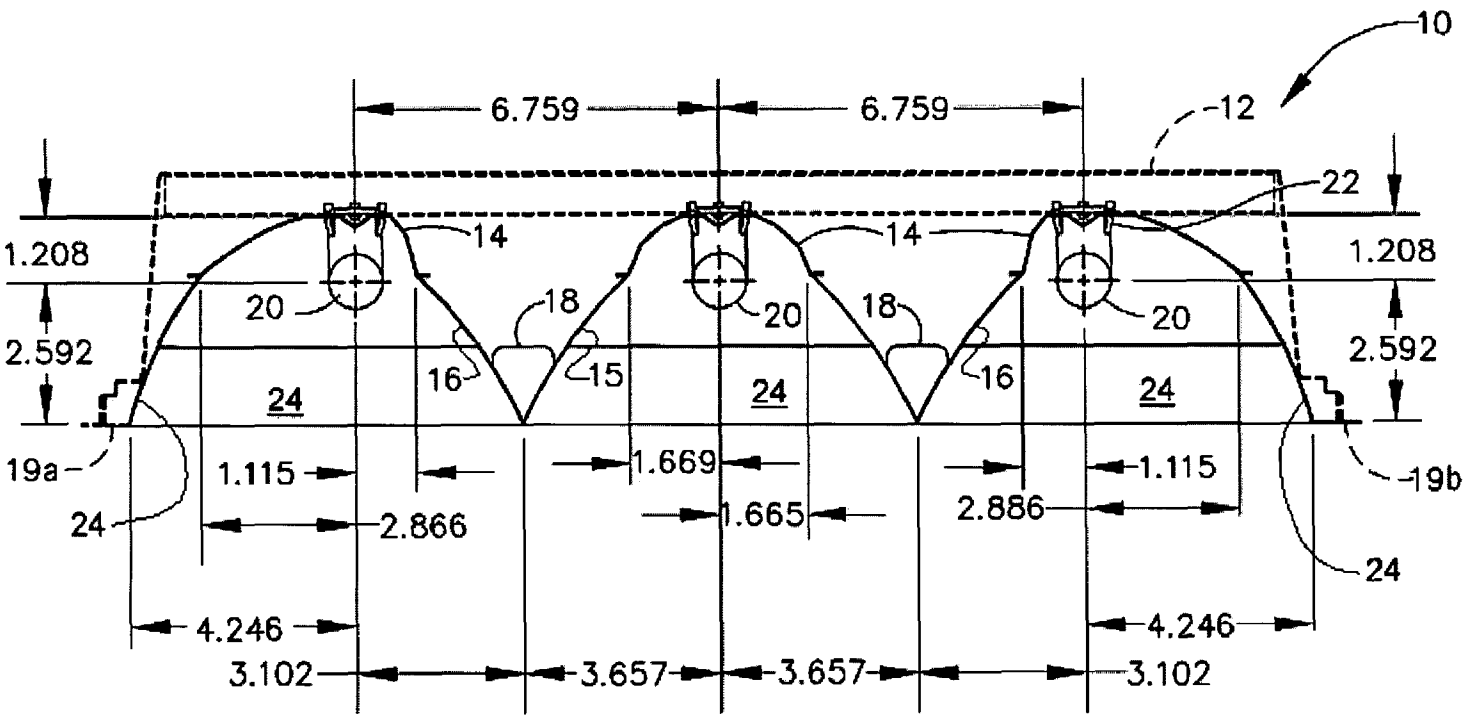
FIG. 1 is a side perspective of the luminaire in accordance with the principles of the present invention.
Figure 5:
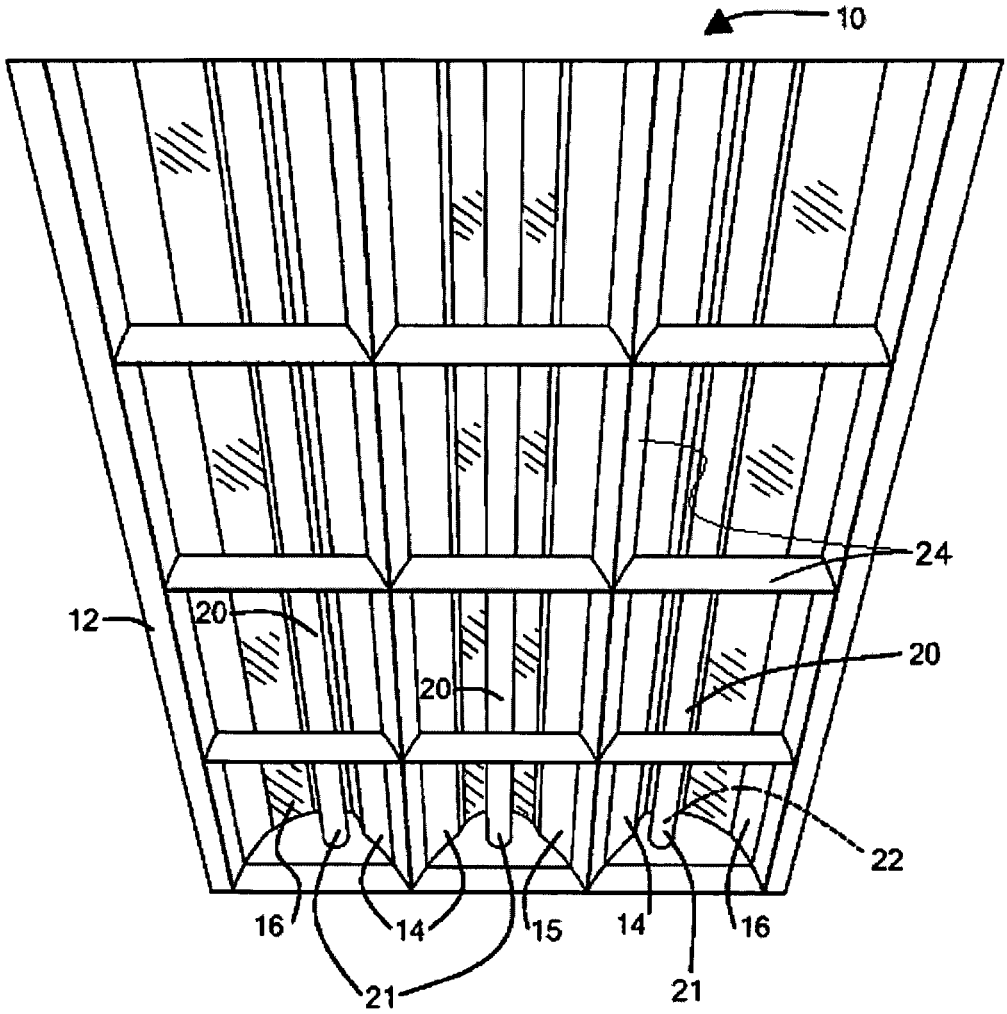
FIG. 5 is a bottom perspective view of a portion of the luminaire.

The luminaire 10, as depicted in FIGS. 1 and 5, comprises a housing 12 in which three reflectors 14 are disposed, including a center reflector 15 and side reflectors 16. While it would be possible to form the reflectors together in a single piece, it is more convenient to form them as separate reflectors. The reflectors 14 are then joined using braces 18 with any common bonding means such as adhesives, screws or locking tabs. The outer edges 19*a* and 19*b* of the side reflectors 16 are then joined to the edge of the housing 12. Within each reflector 14 volume is a lamp 20 having a base at each opposed end 21, and which is held in place at the ends 21 via a set of commonly used fluorescent tube sockets 22. The sockets are electrically connected to a power source, and have an electric contact for electrically connecting to the base of the lamps. Louvers 24, as depicted in FIG. 5, can also be attached to the luminaire 10 to provide additional direction for the light.

FIG. 1 also depicts the placement of the lamps 20 within the reflectors 14. In the preferred embodiment, each of the reflectors 14 is about 7.3 inches wide and 3.8 inches high. The center of each lamp 20 is placed about 1.2 inches below the top of the reflectors 14, and in line with the bottom edge of the upper portion of the reflector. The center of the lamp 20 in the center reflector 15 is centered about 3.65 inches from each outer edge of the center reflector 15 and the lamps 20 of the side reflectors 16 are biased toward the center of the luminaire 10, the center of such lamps 20 being about 3.1 inches from the inner edge of the side reflectors 16 and about 4.2 inches from the outer edges 19*a* and 19*b* of the side reflectors 16. Accordingly, the lamps 20 of the side reflectors 16 are each located about 6.8 inches apart from the lamp 20 of the center reflector 15. The lamps are preferably fluorescent tubes having a length substantially longer than the width of the reflectors.

Figure 2:
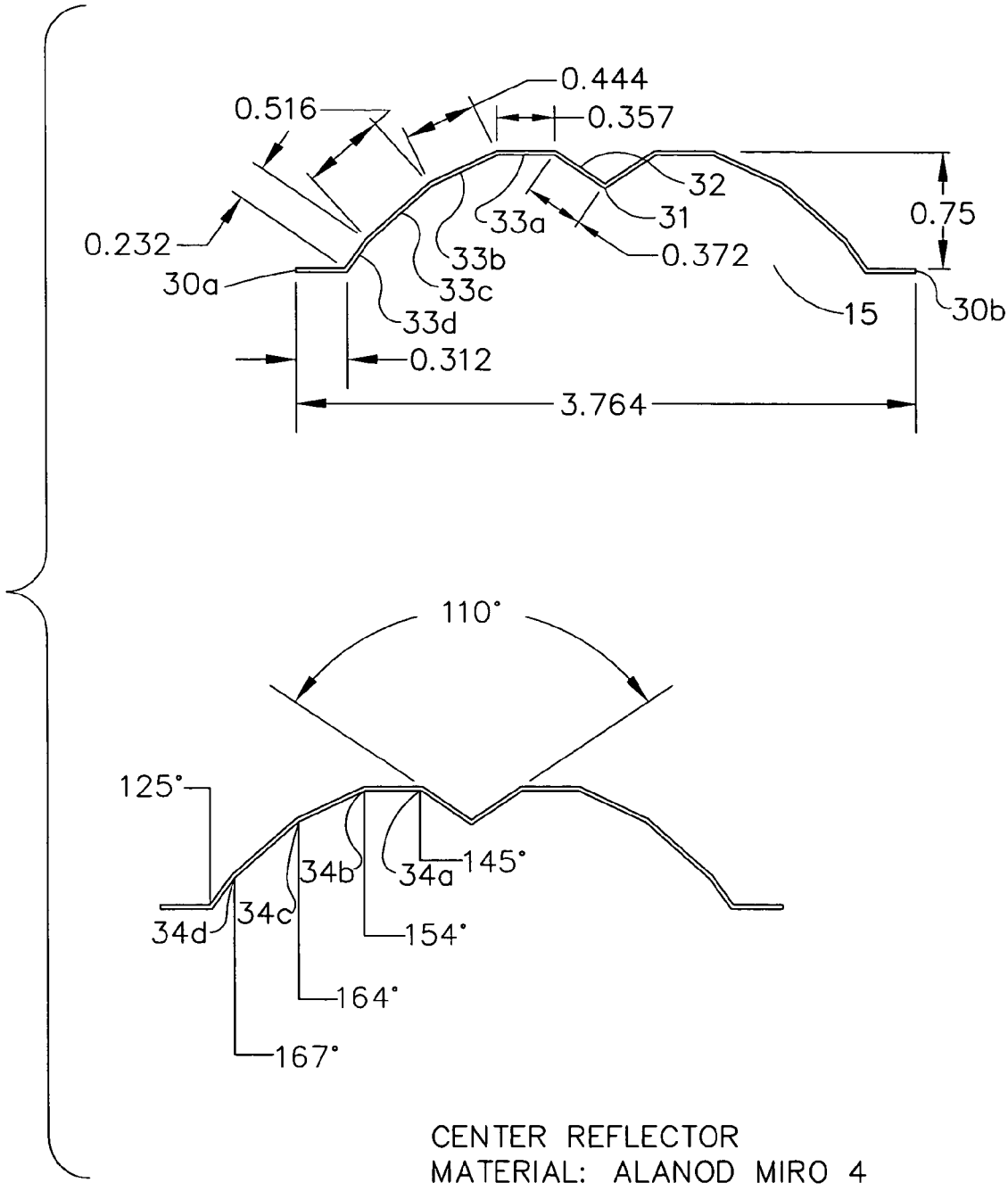
FIG. 2 is a detailed side perspective of the symmetrical center reflector of the luminaire.
Figure 3:
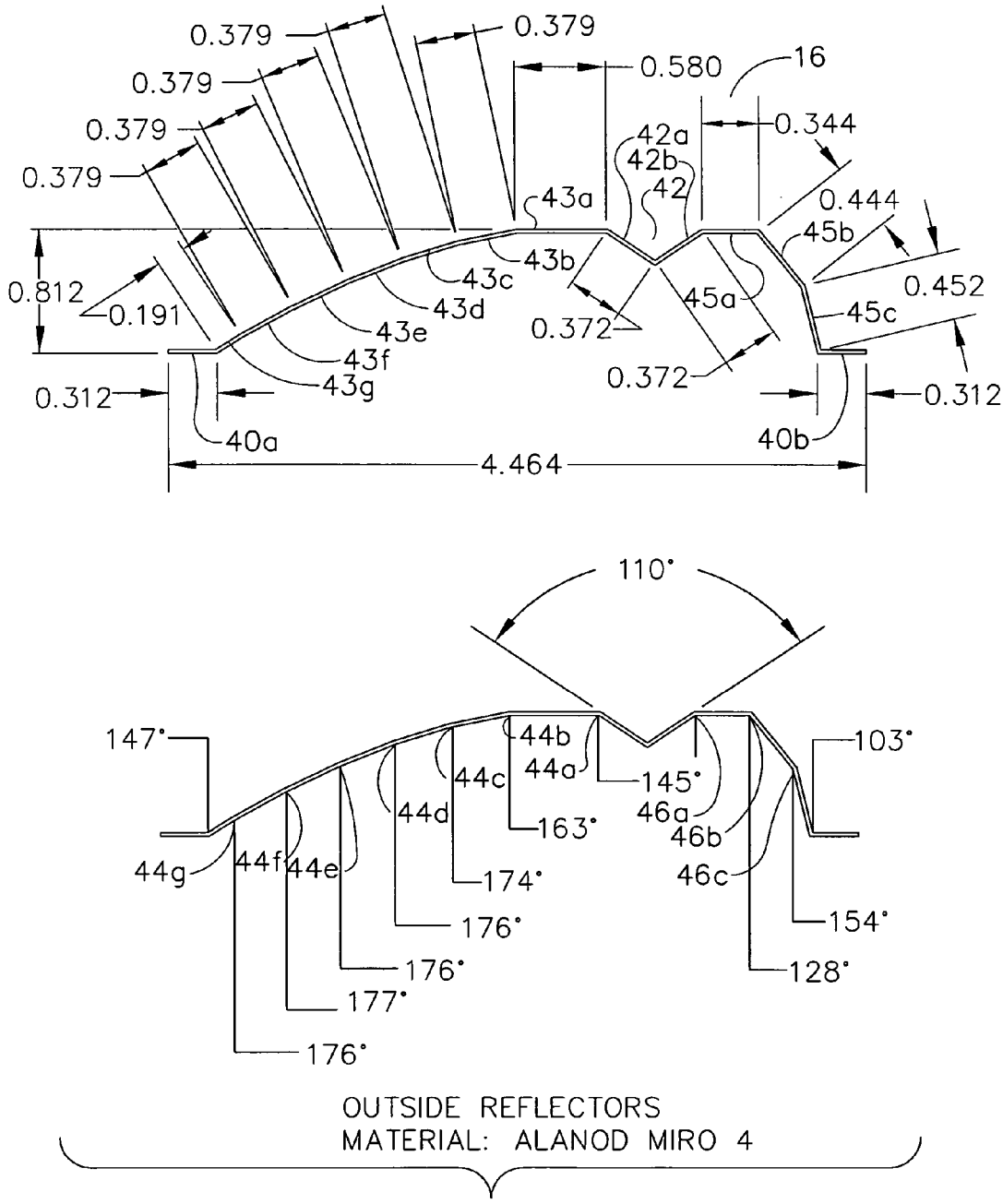
FIG. 3 is a detailed side perspective of the asymmetrical side reflectors of the luminaire.

The upper portions of the reflectors are shown in more detail in FIGS. 2 and 3. The center reflector 15 is symmetrical and the two side reflectors 16 are asymmetrical. From the edge 30*a* to edge 30*b* the preferred reflector embodiment is about 3.75 inches wide. From the center point 31 of the center reflector 15, a V shaped peak 32 having an exterior angle of 110 degrees, and preferably not less than 110 degrees, with the point disposed downward extends in each direction for 0.372 inches. The subsequent segments 33*a*–33*d* are formed at interior angles 34*a*–34*d* with the preceding segments, starting from the end of the peak 32, of 145 degrees, 154 degrees, 164 degrees and 167 degrees, and have respective lengths of 0.357 inches, 0.444 inches, 0.516 inches and 0.232 inches. The reflector 15 terminates from the end of segment 33*d* at an exterior angle of 125 degree with a length of 0.312 inches, thereby forming edges 30*a* and 30*b*. The asymmetrical reflectors 16 have a length measured from the outer edge of edge 40*a* to edge 40*b* of about 4.5 inches. The side reflectors also each start with a V shaped peak 42 having an exterior angle of 110 degrees formed with two segments of 0.372 inches. From the end of the exterior peak segment 42*a*, subsequent reflector segments 43*a*–43*g* are formed at interior angles 44*a*–44*g* with the preceding segment, starting from the peak segment end 42*a*, of 145 degrees, 163 degrees, 174 degrees, 176 degrees, 176 degrees, 177 degrees and 176 degrees and having respective lengths of 0.58 inches, 0.37 inches, 0.379 inches, 0.379 inches, 0.379 inches, 0.379 inches and 0.191 inches. The reflector terminates from the end of segment 43*g* at an exterior angle of 147 degrees with a length of 0.312 inches, thereby forming the outer edges. The other symmetrical side of the reflector is formed with segments 45*a*–45*c* at interior angles 46*a*–46*c* to the preceding segments, starting from the interior end of the peak segment 42*b*, of 145 degrees, 128 degrees and 154 degrees, and having respective lengths of 0.372 inches, 0.444 inches and 0.452 inches. The reflector terminates from the end of segment 45*c* at an exterior angle of 103 degrees with a length of 0.312 inches, thereby forming the inner edges.

Figure 4:
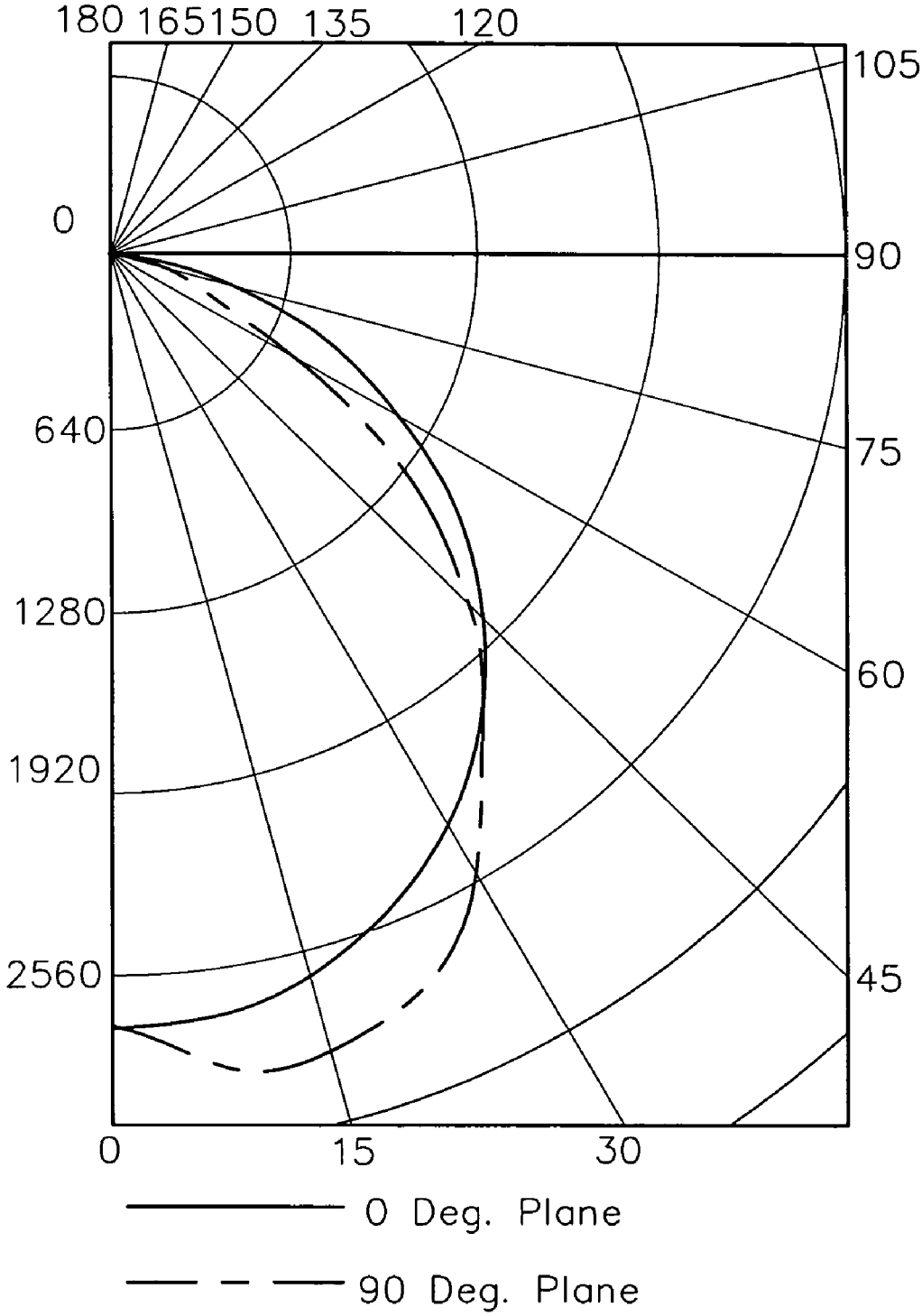
FIG. 4 is a diagram showing the candela distribution for the preferred embodiment of the luminaire.

The resulting luminaire 10 provides wide angle light distribution as shown in the candela distribution chart depicted in FIG. 4.

While the present invention has been illustrated by description of an embodiment which has been described in detail, it is not the intention of the applicant to restrict or in any way limit the scope of the appended claims to such detail. Additional advantages will readily appear to those skilled in the art. Thus, the invention in its broadest aspects is not limited to the specific details, representative apparatus and method, and illustrative examples shown and described. Accordingly, departures may be made from the details without departing from the spirit or scope of applicant's general inventive concept.

What is claimed is:

1. A luminaire comprising: a housing; a plurality of reflectors disposed within said housing comprising at least two asymmetrical reflectors that are symmetrically opposed from each other, and each having a generally parabolic shape, and at least one symmetrical reflector that is located centrally between said asymmetrical reflectors; a plurality of lamps, each having a base at each end, and each disposed beneath and within the volume of each reflector; and lamp sockets disposed at the ends of each reflector, and being sized to receive the base of said lamps, said lamp sockets being electrically connected to a power source and having an electrical contact and being electrically connectable to the bases of said lamps.

2. The luminaire of claim 1 wherein said plurality of reflectors further comprises a second pair of asymmetrical reflectors that are symmetrically opposed to each other.

3. The luminaire of claim 1 wherein the at least one symmetrical reflector comprises at least two symmetrical reflectors located centrally between said asymmetrical reflectors.

4. The luminaire of claim 1 wherein said lamps are fluorescent tubes and the length of said reflectors is substantially longer than the width of said reflectors.

5. The luminaire of claim 1 wherein said reflectors are joined together with a brace behind said reflectors.

6. The luminaire of claim 1 wherein louvers are attached beneath said reflectors and said lamps to provide additional direction for the light emitted from the lamps.

7. The luminaire of claim 1 wherein said lamps disposed within said symmetrical reflectors are disposed equidistant among the width of said symmetrical reflector and said lamps disposed within said asymmetrical reflectors are disposed closer to the inner side of said asymmetrical reflectors.

8. The luminaire of claim 1 wherein said generally parabolic shapes of an upper portion of said asymmetrical reflectors are formed using a plurality of adjacent reflector segments.

9. The luminaire of claim 8 wherein each of said upper portions of each of said asymmetrical reflectors is comprised of seven segments commencing from the end of each segment forming said peak shape portion, said segments formed at respective angles from the end of said peak shape portion element and each subsequent segment at interior angles of 145, 163, 174, 176, 176, 177 and 176 degrees.

10. The luminaire of claim 8 wherein the center of said lamps for all of said reflectors are disposed in line with the bottom edge of said upper portion of said reflectors.

11. The luminaire of claim 1 wherein the portion of each of said reflectors located centrally above said lamp of said reflector has a peak shape.

12. The luminaire of claim 11 wherein said peak shape portion is formed at an exterior angle afoot less than 110 degrees.

13. The luminaire of claim 11 wherein said symmetrical reflector has a generally parabolic shape, and wherein the portion of said asymmetrical, parabolic reflectors located toward the inner side of said peak shape portion is a narrower parabolic shape than the portion of said asymmetrical reflector located toward said outer side of said peak shape portion.

14. The luminaire according to claim 13 wherein said parabolic shape of said symmetrical reflector has an upper portion formed using a plurality of adjacent reflector elements.

15. The luminaire of claim 14 wherein said upper portion of said symmetrical reflector is comprised of four segments commencing from the end of each segment forming said peak shape portion, said segments formed at respective angles from the end of said peak shape portion element and each subsequent segment at interior angles of 145, 154, 164 and 167 degrees.

16. A luminaire for providing wide angle light distribution, comprising: a housing; a plurality of reflectors disposed within said housing, comprising: at least two asymmetrical reflectors that are symmetrically opposed from each other, configured to provide wide angle illumination, and a symmetrical reflector located between the two asymmetrical parabolic reflectors, and having a generally parabolic shape, and wherein the portion of each asymmetrical reflector located centrally above the lamp has a peak shape, the portion of the asymmetrical reflector located toward the inner side of the peak shape portion is a narrower parabolic shape than the portion of the asymmetrical reflector located toward the outer side of the peak shape portion; a plurality of lamps, each having a base at each end, and each disposed beneath and within the volume of each reflector, and lamp sockets disposed at the ends of each reflector, and being sized to receive the base of said lamps, said lamp sockets being electrically connected to a power source and having an electrical contact and being electrically connectable to the bases of said lamps; wherein the areas in the luminaire below the reflectors are substantially open.

17. The luminaire according to claim 16 wherein the each asymmetrical reflector has a parabolic shape.

18. The luminaire according to claim 16 wherein the plurality of reflectors further comprises a second pair of asymmetrical, parabolic-shaped reflectors that are symmetrically opposed to each other.

19. The luminaire according to claim 16 wherein the plurality of reflectors further comprises a second pair of asymmetrical, parabolic-shaped reflectors that are symmetrically opposed to each other.

20. The luminaire according to claim 16 wherein said peak shape portion is formed at an exterior angle of not less than 110 degrees, wherein an upper portion of the symmetrical reflector is comprised of four segments commencing from the end of each segment forming the peak shape portion, the segments formed at respective angles from the end of the end of the peak shape portion element and each subsequent segment at interior angles of 145, 154, 164 and 167 degrees, and wherein an upper portion of each of the asymmetrical reflectors is comprised of seven segments commencing from the end of each segment forming the peak shape portion, the segments formed at respective angles from the end of the peak shape portion, the segments formed at respective angles from the end of the peak shape portion element and each subsequent segment at interior angles of 145, 163, 174, 176, 176, 177 and 176 degrees.

* * * * *

UNITED STATES PATENT AND TRADEMARK OFFICE

CERTIFICATE OF CORRECTION

PATENT NO. : 7,029,148 B2
APPLICATION NO. : 10/616743
DATED : April 18, 2006
INVENTOR(S) : White et al.

It is certified that error appears in the above-identified patent and that said Letters Patent is hereby corrected as shown below:

Claim 12, Col. 5, line 44, delete “afoot” and insert --of not--.

Signed and Sealed this

Second Day of January, 2007

JON W. DUDAS
*Director of the United States Patent and Trademark Office*